US007380553B2

(12) United States Patent
Keller

(10) Patent No.: US 7,380,553 B2
(45) Date of Patent: Jun. 3, 2008

(54) RECEPTACLE FOR EXTINGUISHING AND STORING CIGARETTE BUTTS

(76) Inventor: Kenneth L. Keller, 4614 Deep River Pl., Jacksonville, FL (US) 32224

( * ) Notice: Subject to any disclaimer, the term of this patent is extended or adjusted under 35 U.S.C. 154(b) by 551 days.

(21) Appl. No.: 10/867,002

(22) Filed: Jun. 14, 2004

(65) Prior Publication Data

US 2005/0274389 A1 Dec. 15, 2005

(51) Int. Cl.
*A24F 13/18* (2006.01)
*A24F 19/14* (2006.01)

(52) U.S. Cl. ..... 131/235.1; 131/250; 220/259.2; 241/100

(58) Field of Classification Search ..... 131/231, 131/250

See application file for complete search history.

(56) References Cited

U.S. PATENT DOCUMENTS

| | | | | |
|---|---|---|---|---|
| 1,628,114 | A | 5/1927 | Caldwell | |
| 1,637,172 | A | 7/1927 | Burress | |
| 1,820,077 | A * | 8/1931 | Larson | 131/235.1 |
| 2,256,420 | A | 9/1941 | Agee | |
| 2,309,011 | A * | 1/1943 | Porter | 131/256 |
| 2,495,496 | A | 1/1950 | Agee | |
| 2,661,747 | A | 12/1953 | Manion | |
| 2,936,765 | A | 5/1960 | Talkington | |
| 4,055,193 | A | 10/1977 | Lehman | |
| 4,142,537 | A | 3/1979 | Fenelon | |
| 4,146,043 | A | 3/1979 | Itoh | |
| 4,161,181 | A | 7/1979 | Nicks et al. | |
| 4,201,233 | A | 5/1980 | Jean | |
| 4,331,164 | A | 5/1982 | Bodenmann | |
| 4,346,719 | A | 8/1982 | Hilkene | |
| 4,473,084 | A | 9/1984 | Marshall | |
| 4,634,104 | A | 1/1987 | Carr | |
| 4,953,571 | A | 9/1990 | Tremblay | |
| 5,022,533 | A * | 6/1991 | Lin | 211/1.51 |
| 5,022,553 | A * | 6/1991 | Pontius | 206/205 |
| 5,038,801 | A | 8/1991 | Wang | |
| 5,345,952 | A | 9/1994 | Nielander | |
| 5,361,784 | A | 11/1994 | Kinder | |
| 5,601,096 | A | 2/1997 | Lin | |
| 5,617,880 | A | 4/1997 | Landuydt | |
| 5,673,709 | A * | 10/1997 | Brothers | 131/231 |
| 5,676,316 | A * | 10/1997 | Hanna | 241/22 |
| D389,600 | S | 1/1998 | Luedecke | |
| 5,722,438 | A | 3/1998 | Gors | |
| 5,725,310 | A | 3/1998 | Kruczko | |
| 5,727,572 | A | 3/1998 | Gillie | |
| 5,799,781 | A | 9/1998 | Arthur | |
| 5,806,533 | A | 9/1998 | Boling | |
| RE36,106 | E | 2/1999 | Bruno et al. | |
| 5,906,211 | A | 5/1999 | Mason | |

(Continued)

*Primary Examiner*—Philip C Tucker
*Assistant Examiner*—Phu H Nguyen
(74) *Attorney, Agent, or Firm*—Thomas C. Saitta

(57) ABSTRACT

A receptacle for extinguishing and storing spent smoking items, namely cigarette or cigar butts, comprising a container and a cap connected to the container for receiving and storing the butts. The cap contains a porous snuffing tube formed within and through the cap and an odor absorbent material contained within the cap. The odor absorbent material absorbs the smoke and odors emitted from the butt when it is being extinguished within the snuffing tube. Once the spent smoking item is extinguished within the tube it is then released into the container.

14 Claims, 3 Drawing Sheets

U.S. PATENT DOCUMENTS

| | | | | |
|---|---|---|---|---|
| 5,906,314 | A | 5/1999 | Kinay | |
| 5,924,425 | A | 7/1999 | Luedecke | |
| D414,889 | S | 10/1999 | Luedecke | |
| 5,971,463 | A | 10/1999 | Nowak et al. | |
| 6,116,246 | A | 9/2000 | Glenn et al. | |
| 6,161,549 | A | 12/2000 | Lee | |
| 6,170,490 | B1 | 1/2001 | Barrow | |
| D442,736 | S | 5/2001 | McGilvray | |
| 6,427,960 | B1 | 8/2002 | Gehring et al. | |
| 6,439,240 | B1 | 8/2002 | Yamamoto et al. | |
| 6,454,122 | B1 | 9/2002 | Luedecke | |
| D468,857 | S | 1/2003 | Foote | |
| 6,604,530 | B1 | 8/2003 | Rogari et al. | |
| 6,626,322 | B1 | 9/2003 | Carter et al. | |
| 2003/0172943 | A1* | 9/2003 | Connolly | 131/250 |
| 2003/0200974 | A1* | 10/2003 | Shaw et al. | 131/238 |

* cited by examiner

RECEPTACLE FOR EXTINGUISHING AND STORING CIGARETTE BUTTS

TECHNICAL FIELD

The invention generally relates to receptacles for spent smoking materials, namely cigarette or cigar butts. More specifically, the invention relates to a repository that accepts cigarette butts and extinguishes any smoldering smoking material while containing odors.

BACKGROUND

When ignited, tobacco products such as cigars and cigarettes produce an unused remnant or butt, which a smoker must dispose of. In recent years, there has been significant public opposition to smoking in general, which has led to prohibition of smoking in such places as restaurants, nightclubs, hotels, airlines, and the workplace. This ban on smoking has resulted in the removal of many waste receptacles for tobacco remnants. In many places, smokers are now forced to go outside to smoke and sometimes are limited to only specific outdoor locations away from buildings. Moreover, many public places do not provide ashtrays or other receptacles for tobacco product remnants for the express purpose of dissuading persons from smoking. Additionally, many automakers no longer build cars having ashtrays to dissuade smoking while driving. Thus, smokers in automobiles will often dispose of their spent cigarette remnants by throwing them out of the automobile onto the roadside. Even in vehicles with ashtrays, many smokers prefer to litter the roadside rather than placing the cigarette butts into the ashtray for later removal. Such action is certainly deleterious to the environment with regard to litter and fire potential. It is in response to the foregoing problems that the present invention is primarily directed to address.

Because of this opposition to smoking, conscientious smokers will often take along containers to collect the tobacco product ashes and remnants when they go to the outdoor areas to smoke. Such containers are also especially useful within vehicles which do not have ashtrays. The containers are generally simple ashtrays or cups (or even empty soda cans), used solely to collect tobacco product remnants, and which, among other problems, do not prevent the smoke and odors from the spent smoking materials from dissipating into the environment, and/or do not conceal the unsightly spent smoking materials, and/or cannot be easily emptied, and/or are not reusable. The previously known containers, however, all suffer from certain drawbacks, such as the failure of the device to provide a quick extinguishing mechanism to prevent the cigarette butt from smoldering for an excessive period of time, the failure to capture smoke emitted from the cigarette butt, and the failure to capture or conceal odors produced by the cigarette butt.

Thus what is needed is a portable device capable of extinguishing and collecting a cigarette butt while reducing or eliminating odor.

SUMMARY

Briefly described, the present invention comprises a receptacle for extinguishing and storing a spent smoking item, namely a cigarette or cigar butt, with the invention comprising a container and a cap connected to the container for receiving and storing the spent smoking items. The cap contains a snuffing or extinguishing tube formed within and extending through the cap, and an odor absorbent material contained within the cap. The snuffing tube serves to quickly extinguish the smoldering cigarette butt. The odor absorbent material absorbs the smoke itself and the odors emitted from the spent smoking item when it is being extinguished within the snuffing tube. Once the cigarette or cigar butt is extinguished within the tube, it is then released into the container.

In greater detail, the receptacle for extinguishing and storing a cigarette butt includes a snuffing tube having porous or apertured walls such that smoke and gases will pass therethrough. Preferably, the walls are formed from a metal wire mesh allowing smoke and gases to pass through the snuffing tube into the cap containing the odor absorbent material. The odor absorbent material may be comprised, for example, of activated charcoal, sodium bicarbonate or like material of similar properties. The odor absorbent material absorbs the smoke and foul odors emitted from the cigarette or cigar butt. Additionally a gate or door is included at the bottom of the snuffing tube in which the lit end of the cigarette or cigar butt is extinguished. Once the smoking item is extinguished the door is removed from the bottom of the snuffing tube, thus allowing the extinguished smoking item to fall into the relatively large open interior of the container.

DETAILED DESCRIPTION

Referring now in more detail to the drawings, in which like numerals represent like components within the several views, the invention will be described with regard for the best mode and the preferred embodiment. In general, the invention comprises in combination a container and a cap that together define a receptacle for spent smoking items, namely cigarette or cigar butts, wherein means to extinguish or snuff the butts are provided, with the extinguishing means having means to absorb smoke and odor from the butts during the extinguishing process. For purposes of simplification, the term butt as used herein shall be taken to define and encompass both cigarette and cigar butts.

Figure 1:
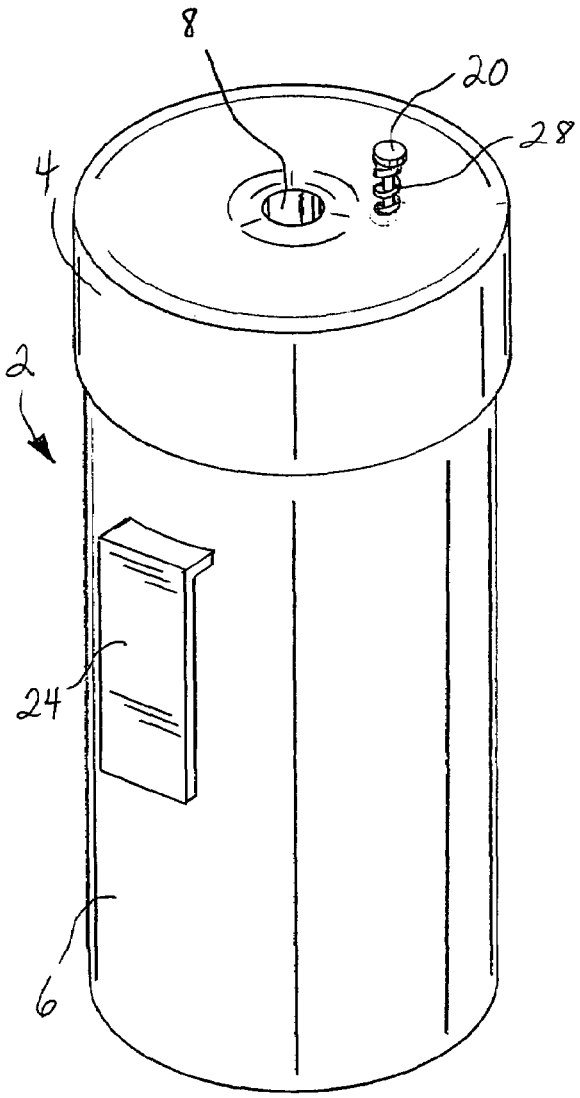
FIG. 1 is a perspective view of an embodiment of the portable receptacle for extinguishing and storing cigarette or cigar butts.
Figure 3:
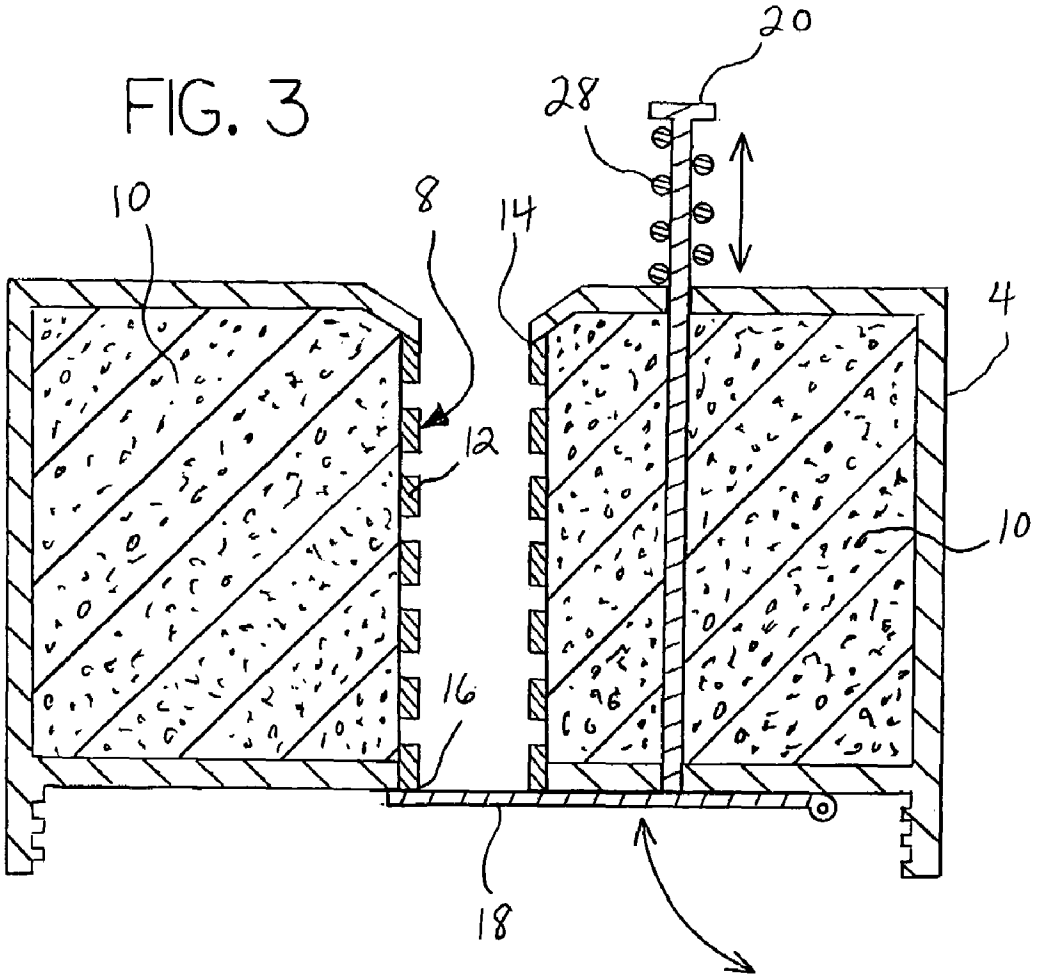
FIG. 3 is a side cross-sectional view illustrating the cap portion containing the odor absorbent materials.

FIG. 1 illustrates a perspective view of the portable receptacle for spent smoking materials, namely cigarette or cigar butts, which embodies the principles of this present invention. The receptacle 2 is generally comprised of a cap 4 and a container 6. The cap 4 has a snuffing or extinguishing tube 8 extending through the cap 4, as shown in FIG. 3, whereby a butt may be directed through the cap 4 and into the container 6 by inserting the butt longitudinally into the first or upper end 14 of the snuffing tube 8. The container 6 portion of the receptacle 2 is of sufficient size to receive a relatively large number of butts before reaching capacity.

Figure 2:
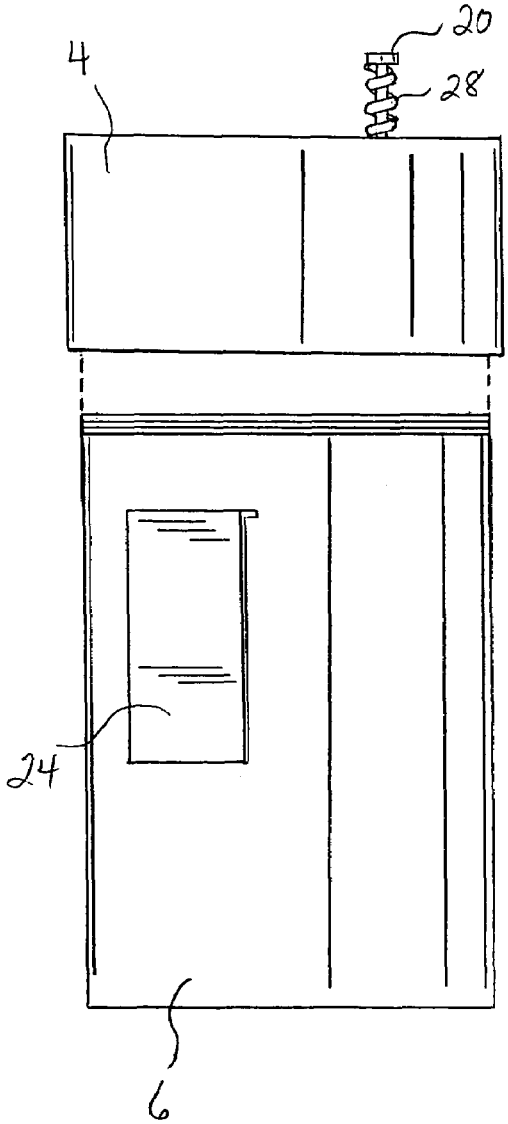
FIG. 2 is an expanded side view of the portable receptacle for cigarette or cigar butts illustrating the cap selectively detached from the container.

The cap 4 and container 6 are typically molded from a thermo-plastic, although other rigid, fire resistant materials are acceptably used, such as metal or acrylics. The cap 4 may be permanently joined to the container 6, but preferably connector means are provided whereby the cap 4 is removable from the container 6, and is preferably connected using a male and female threaded screw mechanism as shown in FIGS. 2 and 3. However, it is contemplated that other attachment mechanisms may be employed, such as for example a snap cap or other friction fit devices. Provision of a removable cap 4 enables the receptacle 2 to be reused after emptying the container 6 of butts, and also allows the odor absorbing material to be replaced once the absorption characteristics become diminished.

The container 6 and cap 4 preferably have a cylindrical shape, thereby enabling the invention to be retained within the cylindrical cup holders provided in most automobiles. However the configuration of the smoking receptacle 2 is not limited to any specific shape or design. The container 6 also may optionally have a handle 24 as shown in FIG. 1, the handle 24 providing an easier mechanism for gripping the receptacle 2 or acting as a window clip or belt clip for securing the receptacle 2.

FIG. 3 is a cross-sectional view of the cap 4. The cap 4 contains a hollow chamber which retains an odor absorbing material 10. The odor absorbing material 10 may be any odor absorbing material having the capacity to absorb smoke and odors emitted by burning tobacco, such as for example activated charcoal or sodium bicarbonate (baking soda). The walls 12 of the snuffing tube 8 are porous or apertured, and in one instance may be formed from a wire mesh. The walls 12 of the snuffing tube 8 are porous such that when the butt is extinguished within the snuffing tube 8, the smoke and gases will travel through the walls 12 of the snuffing tube 8 and come into contact with the odor absorbing material 10 contained within the cap 4. Thus, the smoke and foul odor of the butt will be absorbed by the odor absorbent material 10 and not emitted into the air when the butt is extinguished. Preferably, the upper end 14 for the snuffing tube 8 is funnel shaped to make insertion of the butt easier, and may be covered by a hinged or pivotable flap or lid. In an alternative embodiment, the snuffing tube 8 may be formed as a bore within a relatively rigid block of odor absorbing material 10.

The snuffing tube 8 is dimensioned to receive the butt, whereby the length of the snuffing tube 8 is greater than the length of a typical butt. The diameter of the snuffing tube is slightly greater than the diameter of the butt to be extinguished, such that the free space surrounding the butt is limited, but the butt remains free to fall through and out of the snuffing tube 8 by gravity alone. Since the smoking material may be a cigarette or cigar butt, it is contemplated that the snuffing tube 8 may have different dimensions depending upon the type of smoking material to be extinguished. For example, when the smoking material to be extinguished is a cigar, the snuffing tube 8 would have a larger diameter than that designed to receive a cigarette.

FIG. 3 shows in greater detail the preferred embodiment for the gate or door 18 attached to the second or lower end 16 of the snuffing tube 8. The door 18 helps to facilitate the extinguishing of the smoking item by blocking oxygen and by dissipating heat, since the ignited end of the butt rests against the closed trap door 18 upon insertion. Once the butt has been extinguished, the door 18 is opened by door actuation means and the spent smoking item is allowed to fall into the container 6. The door 18 may be released and opened by the use of a actuator member 20 biased by a spring 28 as shown, the door 18 being pivotally attached to the underside of cap 4 and normally retained in the closed position by suitable biasing means. However, other door actuation means, such as for example a sliding mechanism that allows the door 18 to withdrawn laterally in a linear or arced direction to expose the lower opening 16, are also contemplated by the present invention.

Figure 4:
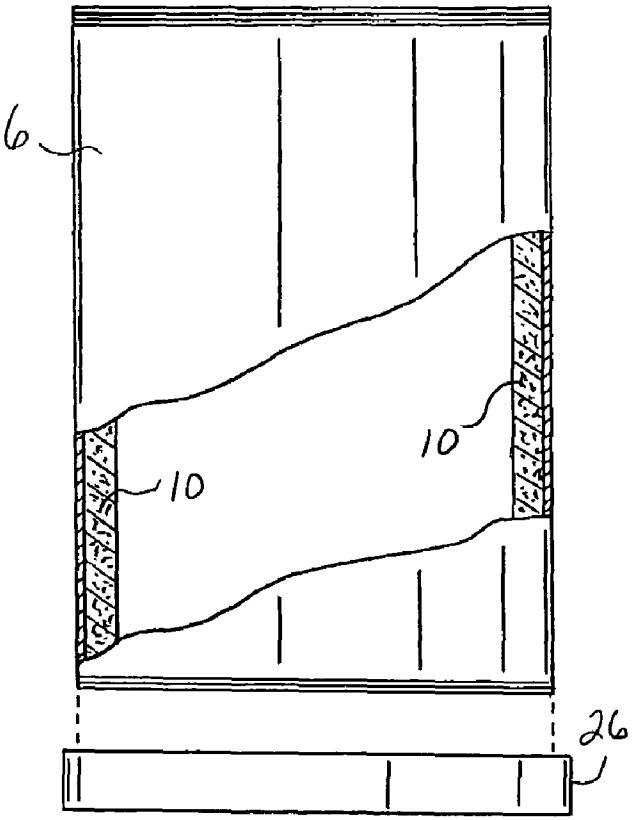
FIG. 4 is a side view, shown partially in exposed cross-section, illustrating the container with an optional removable bottom and the container also having an odor absorbing material lining its interior wall.

FIG. 4 is a cross-sectional view of the container 6 which is designed to receive the extinguished butt upon release from the snuffing tube 8. The interior wall of the container 6 in one embodiment may be lined with additional odor absorbing material 10. The odor absorbing material 10 lining the container 6 further reduces any emissions by the spent smoking items. Furthermore, the odor absorbing material 10 would attract any tars or nicotine, thus aiding in keeping the container relatively clean. Additionally the container 6 may be provided with a removable bottom cap 26 that provides an alternative mechanism for removal of the butts from the container 6. The removable bottom cap 26 may be attached to the container 6 using a screw type mechanism or any other selectively attached mechanism known in the art.

Figure 5:
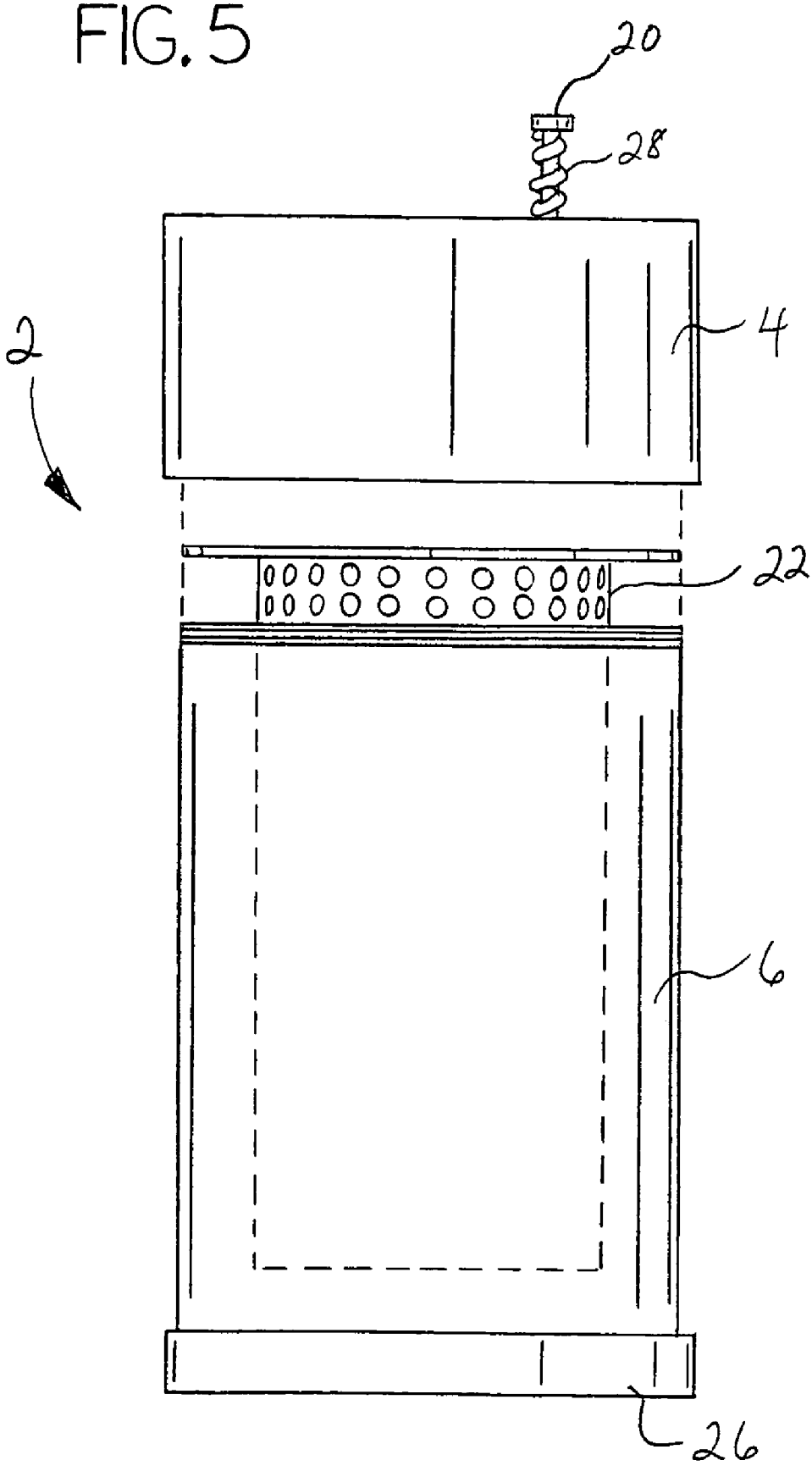
FIG. 5 is an expanded side view of the portable receptacle for cigarette or cigar butts illustrating the removable cap and container and an annular mesh member fitting within the container for restraining odor absorbing material about the interior wall of the container.

FIG. 5 illustrates a further embodiment in an expanded view of the present receptacle 2. FIG. 5 illustrates that a porous mesh, screen or otherwise apertured annular wall member 22 may be removably inserted within the container 6. The removable mesh 22 restrains the odor absorbing material 10 against the interior wall of the container 6 and allows the odor absorbing material 10 to be replaced as needed.

Accordingly, a method of extinguishing and storing a spent smoking item is also contemplated in the present invention. The method includes extinguishing a butt within a partially enclosed chamber. While the smoking item is being extinguished the method also includes substantially absorbing the odors from the smoking item as it is being extinguished within the chamber and the method then includes transferring the extinguished smoking item from the partially enclosed chamber to the container. A further step method includes absorbing odors within the container in which the spent smoking item is stored.

The smoker inserts or drops the butt into the snuffing tube 8 with the ignited end inserted first. The butt drops to abut the door 18, at which time the ignited tobacco is quickly snuffed by the combination of heat dissipation and oxygen deprivation. Any smoke and odor is absorbed by the odor absorbing material 10 contained within the cap 4. The smoker then opens or releases the door 18 by activating the door actuation means, such as by depressing the actuator member 20, thus allowing the extinguished butt to fall into the container 6. When the container 6 approaches capacity, the butts are disposed of by removing the cap 2 or the bottom 26.

While there has been shown embodiment of the present invention it is to be understood that certain changes, additions, deletions, and alterations in the forms and arrangements of parts may be affected without the party from the underlying ideas or principles of this invention as set forth in the claims appended herein. In addition, the corresponding structures, materials, acts and equivalents of means of step plus function elements of the claims are intended to include any structure, material, or act for performing the functioning combination with other claim elements, as specifically claimed herein.

I claim:

1. A receptacle for extinguishing and storing a butt comprising:

a container;

a cap connected to the container;

a snuffing tube formed within and through the cap, said snuffing tube comprising a first open end and a second open end operatively aligned with each other, and further comprising a door covering the second open end, wherein said door is pivotally connected to the cap for closing off the second opening of the snuffing tube, wherein said snuffing tube extinguishes a butt prior to said butt passing through said door and into said container; and an odor absorbing material contained within the cap;

wherein the snuffing tube is defined by a porous wall, whereby smoke and gases from within the snuffing tube pass through the snuffing tube to contact the odor absorbing material contained within the cap.

2. The receptacle of claim 1, wherein an actuator is coupled to the door for pivotally moving the flap into an open position to such an extent to allow the smoking item to fall into the container from within the snuffing tube.

3. The receptacle of claim 2, wherein the actuator comprises a rod extending from the door through the cap.

4. The receptacle of claim 1, wherein the container includes an odor absorbing material.

5. The receptacle of claim 4, wherein the odor absorbing material is housed within the container by a porous mesh.

6. The receptacle of claim 5, wherein the mesh is removable.

7. The receptacle of claim 1, wherein the odor absorbing material is selected from the group consisting essentially of activated charcoal, sodium bicarbonate and mixtures thereof.

8. The receptacle of claim 1, wherein the container has a first open end and a second open end, wherein the first open end receives the cap and the second open end receives a removably connected bottom tray for removing the spent smoking items.

9. The receptacle of claim 1, wherein the container further includes a handle.

10. The receptacle of claim 1, wherein the cap is removable from the container.

11. A receptacle for extinguishing and storing a butt comprising a substantially hollow container having a first open end and a second open end;

a cap having a cavity formed within and the cap removably connected to the first open end of the container;

a snuffing tube formed within and through the cap, said snuffing tube comprising a first open end and a second open end operatively aligned with each other, and further comprising a door covering the second open end, wherein said door is pivotally connected to the cap for closing off the second opening of the snuffing tube, wherein said snuffing tube extinguishes a butt prior to said butt passing through said door and into said container;

an odor absorbing material contained within the cap; and a bottom removably connected to the second open end of the container;

wherein the snuffing tube is defined by porous walls, whereby smoke and gases from within the snuffing tube pass through the snuffing tube to contact the odor absorbing material contained within the cap.

12. The receptacle of claim 11, wherein an actuator is coupled to said door for particularly moving the door into an open position to such an extent to allow the butt to fall into the container from within the snuffing tube.

13. The receptacle of claim 12, wherein the container includes an odor absorbing material held in place by a removable mesh.

14. The receptacle of claim 11, wherein the odor absorbing material is selected from the group consisting essentially of activated charcoal, sodium bicarbonate and mixtures thereof.

* * * * *